US010906302B2

(12) United States Patent
Ohara et al.

(10) Patent No.: US 10,906,302 B2
(45) Date of Patent: Feb. 2, 2021

(54) RECORDING DEVICE AND RECORDING METHOD

(71) Applicant: SEIKO EPSON CORPORATION, Tokyo (JP)

(72) Inventors: Eiichi Ohara, Nagano (JP); Tatsuo Furuta, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/242,074

(22) Filed: Jan. 8, 2019

(65) Prior Publication Data

US 2019/0210363 A1 Jul. 11, 2019

(30) Foreign Application Priority Data

Jan. 10, 2018 (JP) ..... 2018-001691

(51) Int. Cl.

| | |
|---|---|
| ***B41J 2/045*** | (2006.01) |
| ***B41J 2/21*** | (2006.01) |
| ***B41J 25/308*** | (2006.01) |
| *B41J 29/377* | (2006.01) |

(52) U.S. Cl.

CPC ..... *B41J 2/04586* (2013.01); *B41J 2/04573* (2013.01); *B41J 2/2103* (2013.01); *B41J 2/2132* (2013.01); *B41J 25/3088* (2013.01); *B41J 29/377* (2013.01)

(58) Field of Classification Search

CPC ..... B41J 2/04556; B41J 2/04586; B41J 2/04573; B41J 2/2132; B41J 2/2103; B41J 25/3088; B41J 11/0095; B41J 25/308; B41J 29/393

See application file for complete search history.

(56) References Cited

U.S. PATENT DOCUMENTS 8,419,144 B2 * 4/2013 Castillo ..... B41J 11/0035 347/8
9,701,114 B2 * 7/2017 Kojima ..... B41J 2/04503

FOREIGN PATENT DOCUMENTS

JP 2007-307863 A 11/2007
JP 2009-248535 A 10/2009

* cited by examiner

*Primary Examiner* — Thinh H Nguyen
(74) *Attorney, Agent, or Firm* — Global IP Counselors, LLP

(57) ABSTRACT

Provided is a recording device that performs recording on a recording medium by repeating a pass operation of discharging ink from a recording head onto the recording medium during a main scanning operation of moving the recording head in a main scanning direction, and a sub-scanning operation of moving the recording medium relative to the recording head in a sub-scanning direction intersecting with the main scanning direction. An electronic controller stops the main scanning unit for a predetermined stop time determined based on a gap that is a distance between a head surface of the recording head and a recording surface of the recording medium supported by a support unit, prior to the pass operation.

18 Claims, 11 Drawing Sheets

RECORDING DEVICE AND RECORDING METHOD

CROSS-REFERENCE TO RELATED APPLICATIONS

This application claims priority to Japanese Patent Application No. 2018-001691 filed on Jan. 10, 2018. The entire disclosure of Japanese Patent Application No. 2018-001691 is hereby incorporated herein by reference.

BACKGROUND

Technical Field

The invention relates to a recording device configured to perform recording by discharging ink onto a recording medium such as a print sheet, and a recording method performed using such a recording device.

Related Art

In a recording device that executes recording by discharging ink onto a recording surface of a recording medium from a recording head to form dots, it is very important to establish and maintain a suitable, uniform gap between a head surface of the recording head and the recording surface of the recording medium supported by a support member such as a platen during recording in order to achieve high-precision recording. Additionally, when recording is executed with the gap between the head surface of the recording head and the recording surface of the recording medium supported by the support member being narrower than the suitable gap, there is concern that so-called head rubbing will occur, a condition in which the head surface of the recording head comes into contact with the recording surface of the recording medium. When such head rubbing occurs, scratches and marks may occur on the recording surface of the recording medium, or the recording head may become damaged.

Further, to ensure that the gap between the head surface of the recording head and the recording surface of the recording medium supported by the support member is normally a suitable, uniform gap, the gap between the head surface of the recording head and a support surface of the recording medium from the platen or the like (hereinafter referred to as "platen gap") needs to be adjusted in accordance with a thickness of the recording medium.

As a recording device allowing adjustment of the platen gap in accordance with the thickness of the recording medium, there is known, for example, the recording device described in JP-A-2009-248535. This recording device includes a gap adjusting device that adjusts the gap between the head surface of the recording head and the support surface of the recording medium (recorded material), and a detection device capable of detecting the head surface of the recording head and the support surface in a non-contact manner, and can set a gap (hereinafter referred to as "medium gap") between the head surface of the recording head and a surface of the recording medium to an appropriate, constant gap by controlling the gap adjusting device based on the gap between each surface detected by the detection device.

Nevertheless, in the recording device described in JP-A-2009-248535, when the medium gap is set to a larger gap as a suitable gap at which head rubbing does not occur in accordance with the specifications and state of the recording medium, the problem may arise that a recording quality deteriorates in comparison to when the medium gap is not as large.

Specific examples of a case where the medium gap needs to be set to a larger gap include a case where two-sided recording (printing) is performed on the recording medium and efforts are made to avoid head rubbing caused by creases or twists resulting from the swelling of the recording medium after recording has been performed on one side. Further, independent of such swelling of the recording medium, when specifications include a material quality or a thickness that makes the recording medium susceptible to floating upward from the support surface, for example, the medium gap needs to be similarly set to a larger gap to avoid head rubbing. When the medium gap is thus largely set, a variance in a landing position of the ink discharged by the recording head occurs, potentially causing deterioration in recording quality. One cause of an increase in variance in the landing position is understood to be the effects of an airflow that occurs between the head surface of the recording head and the recording surface of the recording medium. This airflow occurs due to a relative movement of the recording head and the recording medium, for example.

SUMMARY

The invention is designed to solve at least a portion of the problems described above, and can be achieved as an application example or an embodiment below.

A recording device according to the application example is a recording device including a recording head provided with a head surface including an array of nozzles configured to discharge ink onto a recording medium, a support unit configured to support the recording medium, a main scanning unit configured to perform a main scanning operation of moving the recording head in a main scanning direction, a sub-scanning unit configured to perform a sub-scanning operation of moving the recording medium relative to the recording head in a sub-scanning direction intersecting with the main scanning direction, a gap adjusting unit configured to adjust a gap that is a distance between the head surface and a recording surface of the recording medium supported by the support unit, and an electronic controller configured to control driving of the main scanning unit, the sub-scanning unit, and the gap adjusting unit. The recording device is configured to perform recording on the recording medium by repeating a pass operation of discharging the ink from the nozzles onto the recording medium during the main scanning operation, and the sub-scanning operation, and the electronic controller is configured to stop the main scanning unit for a predetermined stop time determined based on the gap prior to the pass operation.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
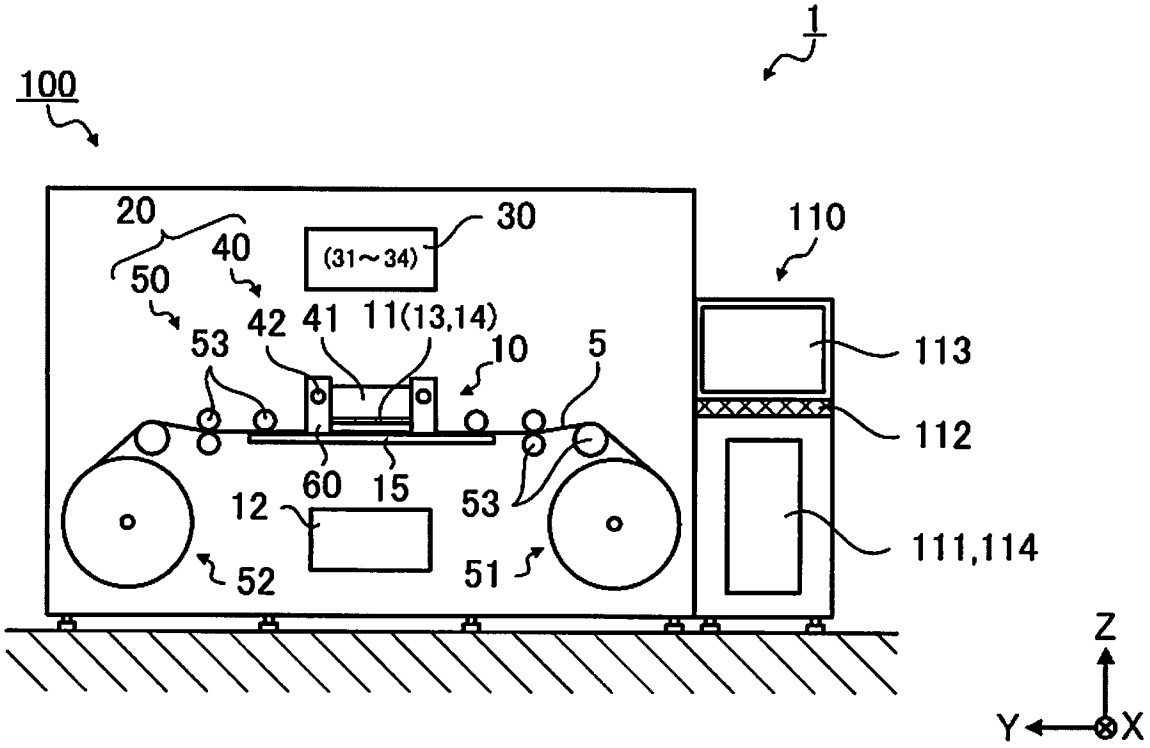
FIG. 1 is a front view illustrating a configuration of a recording device according to an exemplary embodiment.

With reference to the drawings, description is given below of exemplary embodiments of the invention. The following is an exemplary embodiment of the invention and is not intended to limit the invention. Note that the respective drawings may be illustrated not-to-scale, for illustrative clarity. Also, as for coordinates given in the drawings, it is assumed that a Z-axis direction is an up/down direction, a +Z direction is an upward direction, an X-axis direction is a front/rear direction, a −X direction is a frontward direction, a Y-axis direction is a left/right direction, a +Y direction is a leftward direction, and an X-Y plane is a horizontal plane.

Figure 2:
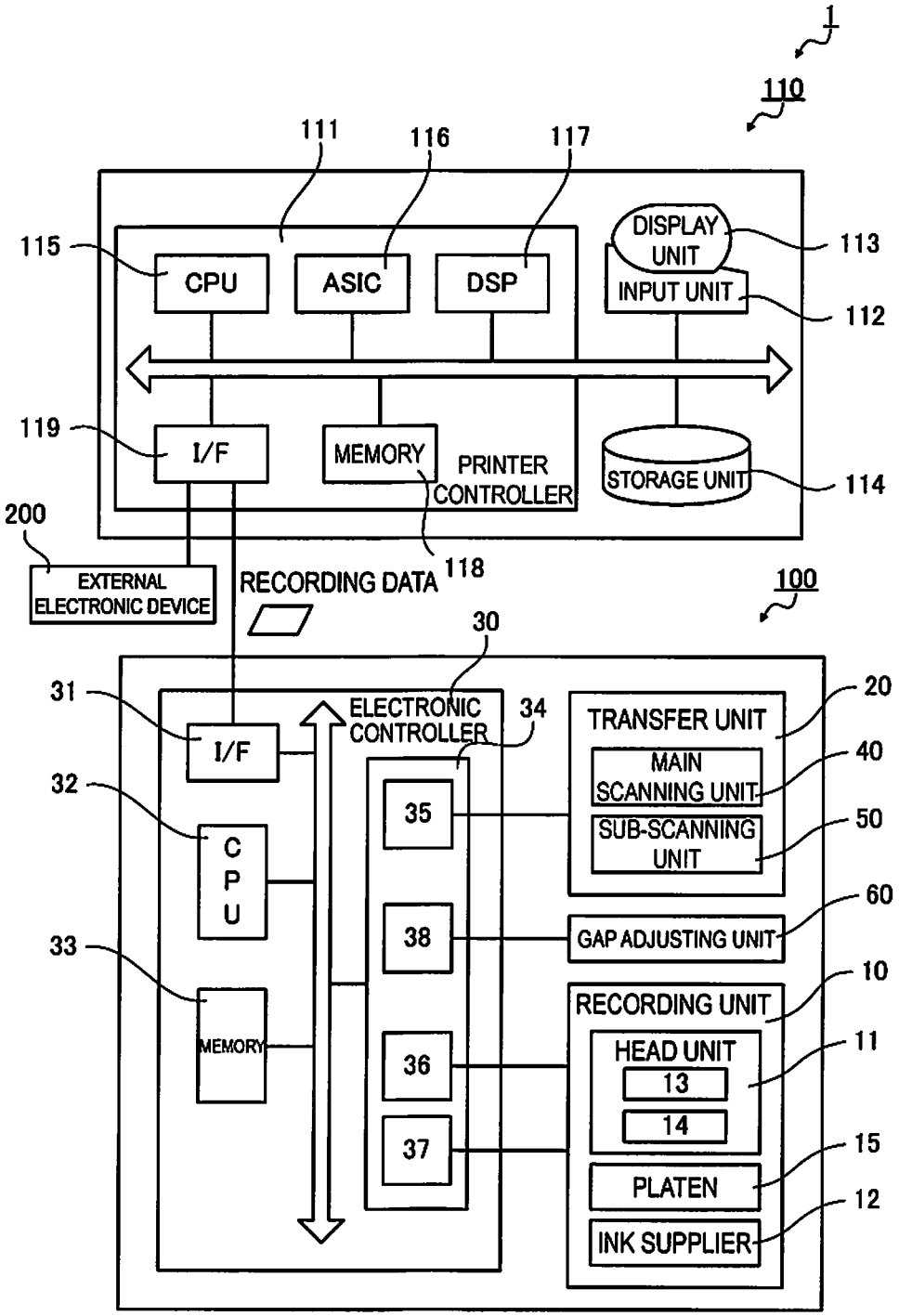
FIG. 2 is a block view illustrating the configuration of the recording device according to the exemplary embodiment.

FIG. 1 is a front view illustrating a configuration of a recording device 1 according to an exemplary embodiment that embodies the invention, and FIG. 2 is a block diagram of the same.

The recording device 1 includes a printer 100, and an image processor 110 connected to the printer 100.

The printer 100 is an ink-jet printer that records a desired image on a roll paper 5 serving as a long "recording medium", which is fed in a state of being wound into a roll, based on recording data received from the image processor 110.

Basic Configuration of Image Processor

The image processor 110 includes a printer controller 111, an input unit 112, a display unit 113, a storage unit 114, and the like, and controls recording jobs to be recorded by the printer 100. As a preferred example, the image processor 110 is configured using a personal computer.

Software operated by the image processor 110 includes general image processing application software (hereinafter referred to as the "application") for handling image data to be recorded, and printer driver software (hereinafter referred to as the "printer driver") for controlling the printer 100 and for generating recording data to allow the printer 100 to execute recording.

That is, the image processor 110 controls the printer 100 via recording data for allowing the printer 100 to record a recording image based on the image data.

Note that the printer driver is not limited to a configuration example as a functional unit using software but can also be configured using firmware, for example. The firmware is, for example, implemented on a system on chip (SOC) in the image processor 110.

The printer controller 111 includes a central processing unit (CPU) 115, an application specific integrated circuit (ASIC) 116, a digital signal processor (DSP) 117, a memory 118, an interface 119, and the like, and centrally controls the recording device 1 in its entirety.

The input unit 112 is an information input means serving as a human interface. Specifically, the input unit 112 is, for example, a port or the like for connecting a keyboard, a mouse pointer, or an information input device.

The display unit 113 is an information display means (display) serving as a human interface, and displays information inputted from the input unit 112, an image to be recorded by the printer 100, information about a recording job, and the like, based on the control of the printer controller 111.

The storage unit 114 is a rewritable storage medium such as a hard disk drive (HDD) or a memory card, and stores software run by the image processor 110 (programs run by the printer controller 111), an image to be recorded, information about a recording job, and the like.

The memory 118 is a storage medium that secures a region for storing programs run by the CPU 115, a work region for running such programs, and the like, and includes storage elements such as a RAM and an EEPROM.

Basic Configuration of Printer 100

The printer 100 includes a recording unit 10, a transfer unit 20, an electronic controller 30, a gap adjusting unit 60, and the like. Upon reception of recording data from the image processor 110, the printer 100 controls the recording unit 10, the transfer unit 20, and the gap adjusting unit 60 by the electronic controller 30 and records (forms) an image on the roll paper 5.

The recording data is image formation data obtained by converting the image data so that the printer 100 can record the recording data using the application and printer driver included in the image processor 110, and includes a command for controlling the printer 100.

The image data includes, for example, general full color image information obtained by a digital camera or the like, text information, and the like.

The recording unit 10 includes a head unit 11, an ink supplier 12, a platen 15 as a "support unit", and the like.

The transfer unit 20 includes a main scanning unit 40, a sub-scanning unit 50, and the like. The main scanning unit 40 includes a carriage 41, a guide shaft 42, a carriage motor (not illustrated), and the like. The sub-scanning unit 50 includes a supply unit 51, a housing unit 52, transport rollers 53, and the like.

The head unit 11 includes a recording head 13 provided with a plurality of nozzles 43 (nozzle group) (refer to FIG. 3) that discharge recording ink (hereinafter referred to as the "ink") as ink droplets as well as a head surface 13S (refer to FIG. 4) on which the nozzles 43 are arranged, and also includes a head controller 14. The head unit 11 is mounted on the carriage 41, and moves back and forth in a main scanning direction (X-axis direction illustrated in FIG. 1) along with the carriage 41 that moves in the main scanning direction. The head unit 11 (recording head 13) forms rows of dot (raster lines) in the main scanning direction on the roll paper 5 by discharging ink droplets onto the roll paper 5 supported by the platen 15 under the control of the electronic controller 30 while moving in the main scanning direction.

The ink supplier 12 includes an ink tank, and an ink supply channel (not illustrated) for supplying the ink to the recording head 13 from the ink tank, and the like. The ink tank, the ink supply channel, and an ink supply path to nozzles 43 that discharge the same ink are provided separately for each ink.

Examples of the ink include a four color ink set obtained by adding black (K) to a three color ink set including cyan (C), magenta (M), and yellow (Y), as an ink set of dark ink compositions. Examples of the ink also include an eight color ink set obtained by adding an ink set of light ink compositions, such as light cyan (Lc), light magenta (Lm), light yellow (Ly), and light black (Lk), with reduced concentrations of the respective color materials.

As for a method of discharging ink droplets (ink-jet method), a piezo method is employed. The piezo method is a method of recording by using a piezoelectric element (piezo element) to apply a pressure corresponding to a recording information signal to the ink stored in a pressure chamber, and thus jetting (discharging) ink droplets from nozzles 43 communicated with the pressure chamber.

Note that the method of discharging ink droplets is not limited thereto, and any other recording method can be employed in which ink is jetted in the form of ink droplets to form dot groups on a recording medium. Examples of such a method can include a method of recording by continuously jetting ink in the form of ink droplets from nozzles 43 by use of an intense electric field between the nozzles 43 and an accelerating electrode provided in front of the nozzles 43, and by sending a recording information signal from a deflecting electrode while the ink droplets are in flight; a method (electrostatic suction method) in which the ink droplets are jetted, without being deflected, according to the recording information signal; a method in which ink droplets are forcibly jetted by pressurizing ink with a small pump and mechanically vibrating the nozzles 43 with a crystal oscillator or the like; a method (thermal jet method) for recording by heating and foaming ink with a microelectrode according to a recording information signal and thus jetting ink droplets; and the like.

The transfer unit 20 (the main scanning unit 40 and the sub-scanning unit 50) moves the roll paper 5 relative to the head unit 11 (recording head 13) under the control of the electronic controller 30.

The guide shaft 42 extends in the main scanning direction and supports the carriage 41 in a slidable contact state. The carriage motor serves as a drive source to move the carriage 41 back and forth along the guide shaft 42.

That is, the main scanning unit 40 (the carriage 41, the guide shaft 42, and the carriage motor) performs a main scanning operation of moving the carriage 41 (that is, the recording head 13) in the main scanning direction along the guide shaft 42 under the control of the electronic controller 30.

The supply unit (reel supporter) 51 rotatably supports a reel with the roll paper 5 rolled therearound, and sends the roll paper 5 to a transport path. The housing unit (reel supporter) 52 rotatably supports the reel that rolls up the roll paper 5, and rolls up the recorded roll paper 5 from the transport path.

The transport rollers 53 include driving rollers for moving the roll paper 5 in a sub-scanning direction (Y-axis direction illustrated in FIG. 1) that intersects with the main scanning direction, driven rollers rotated along with the movement of the roll paper 5, and the like. The transport rollers 53 form the transport path along which the roll paper 5 is transported from the supply unit 51 to the housing unit 52 through a recording region (region where the recording head 13 moves in the main scanning direction on an upper surface of the platen 15) of the recording unit 10.

That is, the sub-scanning unit 50 (the supply unit 51, the housing unit 52, and the transport rollers 53) performs a sub-scanning operation of relatively moving the roll paper 5 in the sub-scanning direction that intersects with the main scanning direction under the control of the electronic controller 30 in the recording region.

The electronic controller 30 includes an interface 31, a CPU 32, a memory 33, a drive controller 34, and the like, and controls the printer 100.

The interface 31 is connected to the interface 119 of the image processor 110 to transmit and receive data between the image processor 110 and the printer 100. The image processor 110 and the printer 100 can be connected directly with a cable or the like, or indirectly through a network or the like. Alternatively, the interface 31 can transmit and receive data between the image processor 110 and the printer 100 through wireless communication.

The CPU 32 is an arithmetic processing unit for overall control of the printer 100.

The memory 33 is a storage medium that secures a region for storing programs run by the CPU 32, a work region for running such programs, and the like, and includes storage elements such as a RAM and an EEPROM.

The CPU 32 controls the recording unit 10 and the transfer unit 20 through the drive controller 34 according to the program stored in the memory 33 and the recording data received from the image processor 110.

The image data to be recorded can be acquired from an external electronic device 200 connected to the interface 119.

The drive controller 34 controls the driving of the recording unit 10 (the head unit 11 and the ink supplier 12), the transfer unit 20 (the main scanning unit 40 and the sub-scanning unit 50), and the gap adjusting unit 60 based on the control of the CPU 32. The drive controller 34 includes a transfer control signal generating circuit 35, a discharge control signal generating circuit 36, a drive signal generating circuit 37, and a gap control circuit 38.

The transfer control signal generating circuit 35 is a circuit that generates a signal for controlling the transfer unit 20 (the main scanning unit 40 and the sub-scanning unit 50) according to an instruction from the CPU 32.

The discharge control signal generating circuit 36 is a circuit that generates a head control signal for selecting nozzles 43 that discharge ink, selecting a discharge amount, controlling the discharge timing, and the like according to an instruction from the CPU 32 based on the recording data.

The drive signal generating circuit 37 is a circuit that generates a basic drive signal including a drive signal that drives the piezoelectric elements of the recording head 13.

The gap control circuit 38 is a circuit that generates a signal that controls the gap adjusting unit 60 according to an instruction from the CPU 32.

The drive controller 34 selectively drives the piezoelectric elements corresponding to the respective nozzles 43 based on the head control signal and the basic drive signal.

Recording Head

Figure 3:
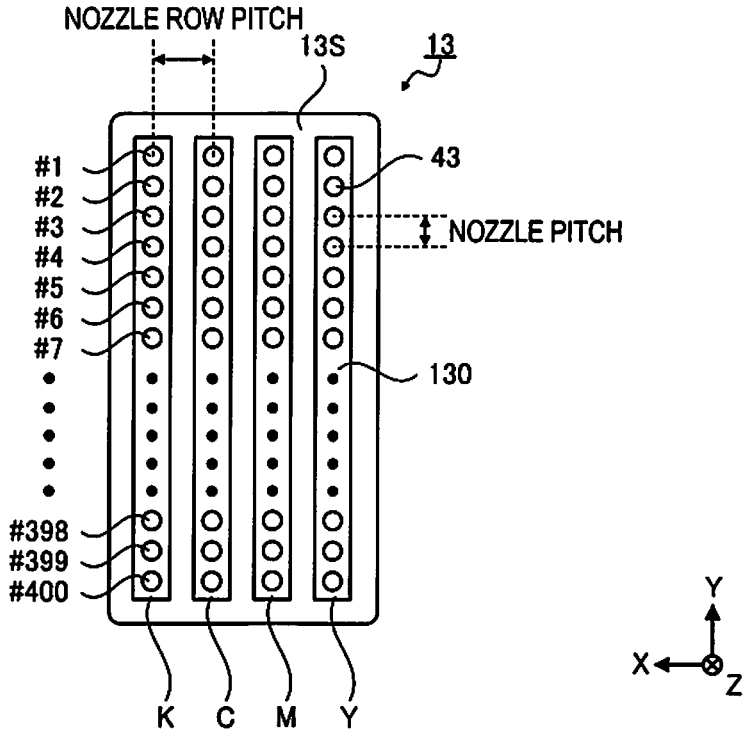
FIG. 3 is a schematic view illustrating an example of an array of nozzles in a recording head.

FIG. 3 is a schematic view illustrating an example of an array of nozzles 43 in the recording head 13. FIG. 3 illustrates a bottom surface (head surface 13S) of the recording head 13 as viewed from below.

As illustrated in FIG. 3, the recording head 13 includes four nozzle rows 130 (a black ink nozzle row K, a cyan ink nozzle row C, a magenta ink nozzle row M, and a yellow ink nozzle row Y) formed by aligning a plurality of nozzles for discharging each ink at a predetermined nozzle pitch. The nozzle rows 130 are arranged in parallel and regularly spaced apart (at the nozzle row pitch) in a direction (X-axis direction) that intersects with the sub-scanning direction (Y-axis direction).

Further, each nozzle 43 is provided with a driving element (such as piezoelectric element as described above) for driving the nozzle 43 and allowing the nozzle 43 to discharge ink droplets.

Gap Adjusting Unit

Figure 4:
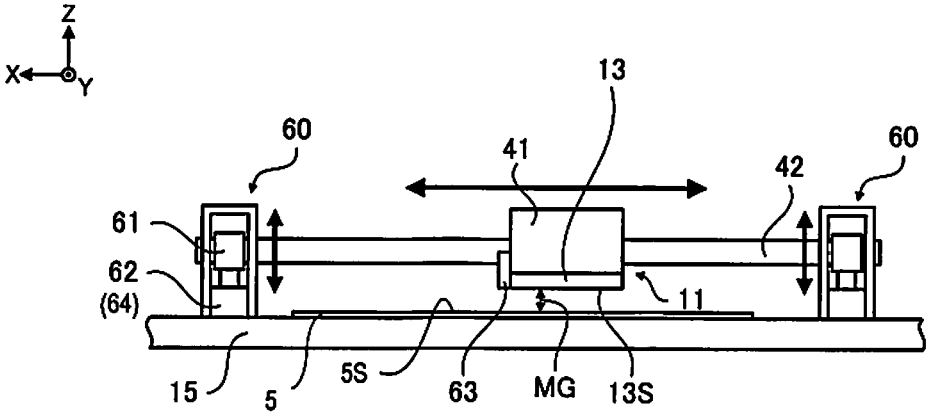
FIG. 4 is a conceptual view illustrating a configuration of a gap adjusting unit.

FIG. 4 is a conceptual view illustrating a configuration of the gap adjusting unit 60.

The gap adjusting unit 60 includes at least a pair of guide shaft support units (guide shaft supports) 61 that support both end portions of the guide shaft 42 extending in the main scanning direction, a pair of guide shaft elevator units (guide shaft elevators) 62 each of which is fixed to the upper surface of the platen 15 on an outer side of the recording region and movably supports the guide shaft support unit 61 in the up-down direction (Z-axis direction), a gap sensor 63 mounted on the carriage 41 and capable of detecting a gap (hereinafter referred to as the "medium gap MG"), which is a distance between the head surface 13S and the recording surface 5S of the roll paper 5 supported by the platen 15), and the like.

Each of the guide shaft elevator units 62 includes a drive motor (gap adjusting drive motor) 64 controlled by a signal from the gap control circuit 38, and can move the guide shaft support units 61 in the up-down direction (Z-axis direction) by the driving of the drive motor 64. The mechanism for moving the guide shaft support units 61 in the up-down direction (Z-axis direction) can be configured by using a mechanism activated by rotating a platen gap (PG) adjustment cam as in the automatic PG adjustment mechanism described in JP-A-2009-248535, a mechanism that utilizes a ball screw and converts the rotation of the drive motor 64 into an up-down motion, or the like.

The gap sensor 63 is an optical height sensor, and can detect the medium gap MG by sensing a reflected light from the roll paper 5 supported by the platen 15, and notify the electronic controller 30 of the results. The electronic controller 30 recognizes data of the medium gap MG detected by the gap sensor 63 prior to recording and, as necessary, corrects the data to the medium gap MG at which an optimum (or more appropriate) recording quality can be achieved. Also, for example, when the guide shaft 42 is inclined (relative to the horizontal direction) in the scanning direction and a difference exists in the medium gap MG in a width direction of the roll paper 5, the inclination of the guide shaft 42 can be corrected by adjusting the amount of raising/lowering by the guide shaft elevator units 62 disposed on both end portions of the guide shaft 42, in accordance with the size of the difference (inclination).

Note that the method for detecting the medium gap MG is not limited to a method of direct measurement using an optical height sensor or the like. For example, a method of calculating the medium gap MG from thickness information of the roll paper 5 and the amount of raising and lowering (up/down movement) by the guide shaft elevator units 62 relative to information about a reference height position of the guide shaft support units 61 can be used.

Basic Function of Printer Driver

Figure 5:
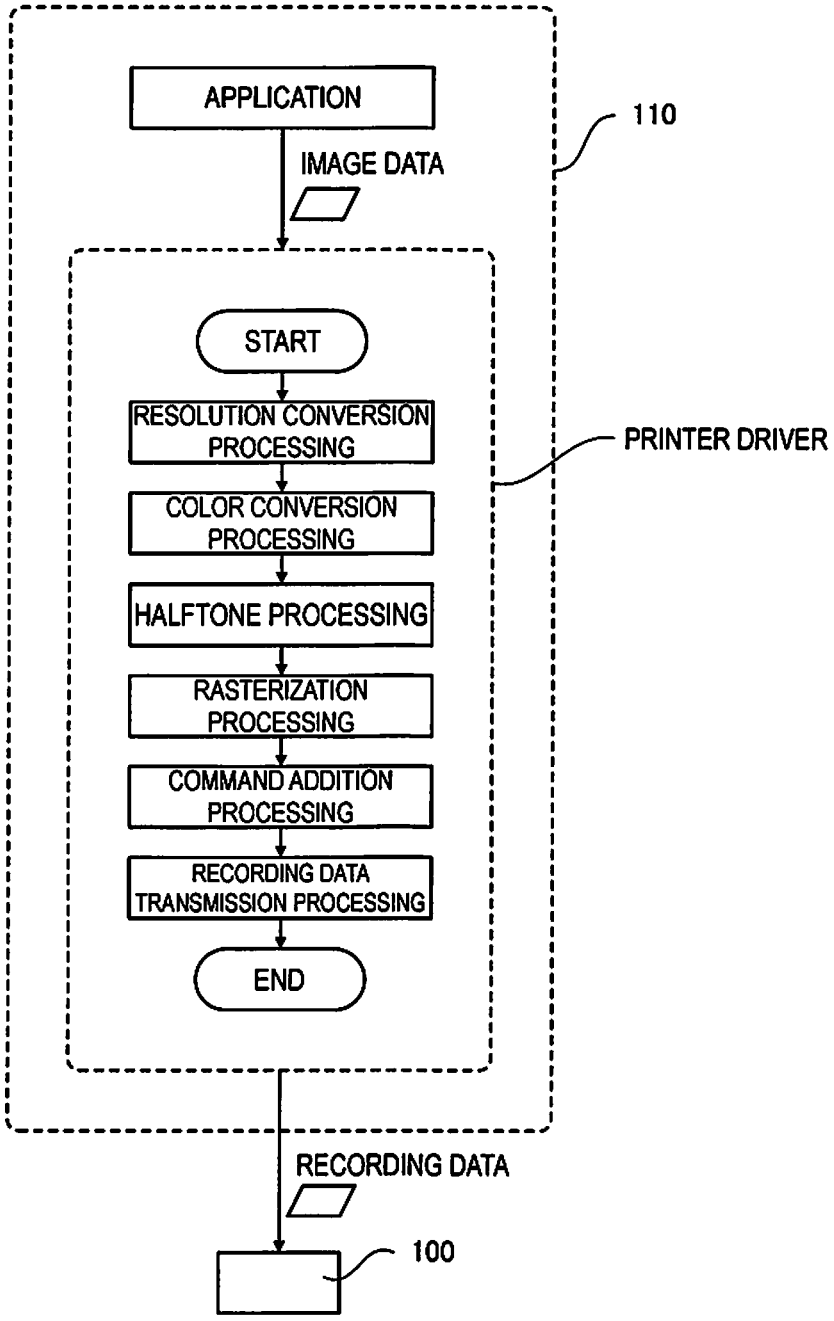
FIG. 5 is an explanatory view of basic functions of a printer driver.

FIG. 5 is an explanatory view of basic functions of the printer driver.

Recording on the roll paper 5 is started by transmitting recording data to the printer 100 from the image processor 110. The recording data is generated by the printer driver.

With reference to FIG. 5, description is given below of the basic details of recording data generation processing.

The printer driver receives image data from the application, converts the image data into recording data in a format that can be interpreted by the printer 100, and then outputs the recording data to the printer 100. For the conversion of the image data from the application into the recording data, the printer driver performs resolution conversion processing, color conversion processing, halftone processing, rasterization processing, command addition processing, recording data transmission processing, and the like.

The resolution conversion processing is processing of converting the image data outputted from the application into a resolution for recording (recording resolution) on the roll paper 5. For example, when the recording resolution is specified as 720×720 dpi, vector format image data received from the application is converted into bit map format image data having a 720×720 dpi resolution. Each pixel data in the image data after the resolution conversion processing includes pixels arranged in a matrix pattern. Each pixel has a tone value in 256 tones (predetermined number of tones), for example, in the RGB color space. That is, each piece of the pixel data after the resolution conversion shows the tone value of the corresponding pixel.

Among the pixels arranged in the matrix pattern, the pixel data corresponding to one row of pixels aligned in a predetermined direction is called raster data. Note that the predetermined direction in which the pixels corresponding to the raster data are aligned corresponds to the direction (main scanning direction) in which the recording head 13 moves when recording an image.

The color conversion processing is processing of converting RGB data into data of a CMYK color system space. CMYK refers to cyan (C), magenta (M), yellow (Y), and black (K). The image data of the CMYK color system space is data corresponding to the colors of the ink of the printer 100. Therefore, when the printer 100 uses ten types of ink of the CMYK color system, the printer driver generates image data in a ten-dimensional space of the CMYK color system based on the RGB data.

This color conversion processing is performed based on a table (color conversion look-up table LUT) in which the tone values of the RGB data and the tone values of the CMYK color system data are associated with each other. Note that the pixel data after the color conversion processing is the CMYK color system data of 256 tones (predetermined number of tones), for example, expressed in the CMYK color system space.

The halftone processing is processing of converting data of 256 tones (predetermined number of tones), for example, into data of a number of tones (a number of tones lower than the predetermined number of tones) that can be formed by the printer 100. Through this halftone processing, data expressing 256 tones, for example, is converted into halftone data for determining dot formation specifications, such as 1-bit data expressing two tones (dot and no dot) and 2-bit data expressing four tones (no dot, small dot, medium dot, and large dot). Specifically, a dot generation rate corresponding to the tone value (in the case of four tones, a generation rate of each of no dot, small dot, medium dot, and large dot, for example) is obtained from a dot generation rate table in which the tone values (0 to 255) and dot generation rates are associated with each other. Then, with the generation rate thus obtained, pixel data is created so that dots are formed in a distributed manner, by using a dither method, an error diffusion method, or the like. Accordingly, the halftone processing generates halftone data that determines the formation specifications of dots formed by the nozzle group that discharges the same color (or type) of ink.

That is, the halftone data aligned in a matrix pattern is data indicating the dot formation specifications including the position where the dot is to be formed and the size of the dot.

The rasterization processing is processing of rearranging the pixel data (for example, the 1-bit or 2-bit halftone data as described above) in the matrix pattern, according to a dot formation order for recording. The rasterization processing includes allocation processing of allocating the image data including the pixel data after the halftone processing (halftone data) to each pass operation in which the recording head 13 (nozzle rows) discharges ink droplets while moving in the main scanning direction. Once the allocation processing is completed, the pixel data in the matrix pattern is allocated to actual nozzles 43 that form respective raster lines constituting the recording image, in each pass operation.

The command addition processing is processing of adding command data corresponding to a recording method, to the rasterized data. The command data includes, for example, transport data related to transport specifications (a travel distance in the sub-scanning direction (Y-axis direction), a speed, and the like) of the recording medium (roll paper 5), and the like.

Such processing by the printer driver is performed by the ASIC 116 and the DSP 117 (refer to FIG. 2) under the control of the CPU 115. Then, the generated recording data is transmitted by recording data transmission processing to the printer 100 through the interface 119.

With the above configuration, the electronic controller 30 forms (records) a desired image on the roll paper 5 by repeating a pass operation of discharging (applying) ink droplets from the recording head 13 onto the roll paper 5 supplied to the recording region by the sub-scanning unit 50 (the supply unit 51 and the transport rollers 53) while moving, in the main scanning direction (X-axis direction), the carriage 41 supporting the recording head 13 along the guide shaft 42, and a sub-scanning operation (feeding operation) of moving (sub-scanning) the roll paper 5 in the sub-scanning direction (Y-axis direction) that intersects with the main scanning direction by the sub-scanning unit 50 (transport rollers 53).

Variance in Landing Position of Ink Droplets

While the electronic controller 30 recognizes the data of the medium gap MG detected by the gap sensor 63 prior to recording and, as necessary, corrects the data to the medium gap MG at which an optimum (or more appropriate) recording quality can be achieved as described above, the medium gap MG needs to be set to a larger gap to avoid head rubbing in which the recording head 13 comes into contact with the roll paper 5 when, for example, specifications include a material quality or a thickness that makes the roll paper 5 susceptible to floating upward. When the medium gap MG is largely set, a variance in a landing position of the ink discharged by the recording head 13 tends to increase, potentially causing deterioration in recording quality. One cause of an increase in variance of the landing position is understood to be the effects of an airflow that occurs between the head surface 13S of the recording head 13 and the recording surface 5S of the roll paper 5. This airflow mainly occurs due to a relative movement of the recording head 13 and the roll paper 5.

Figure 6:
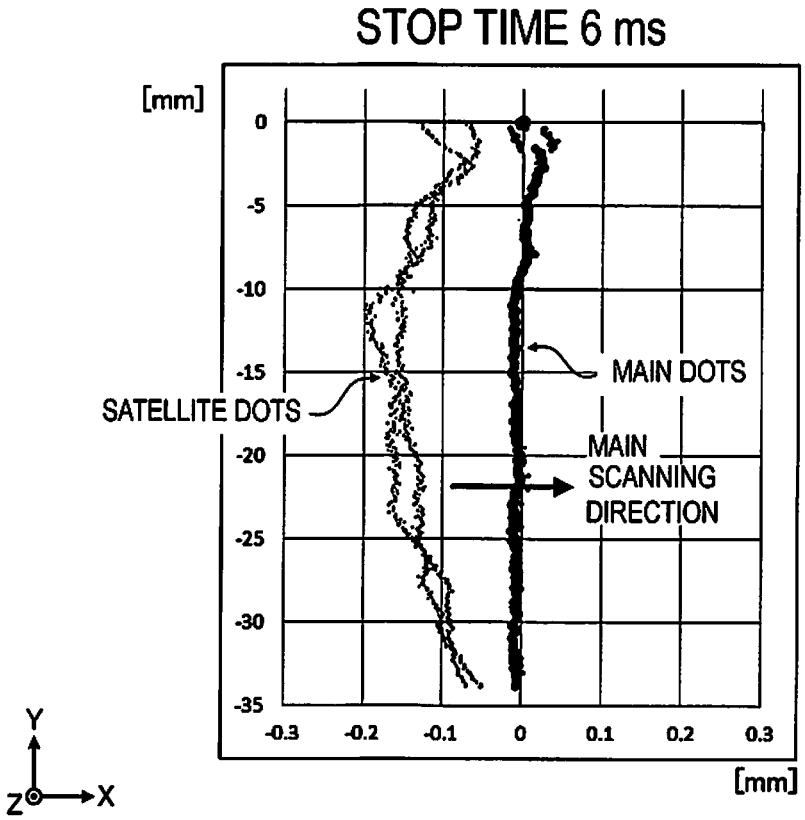
FIG. 6 is an example of a recording image showing variance in landing positions of discharged ink droplets.

FIG. 6 is an example of a recording image showing variance in the landing positions of ink droplets simultaneously discharged from the recording head 13.

To make the ink droplets having a very light weight reliably land on the roll paper 5, an initial speed of the ink droplets is set relatively high. Thus, the ink droplets jetted from the nozzles 43 are extended in flight and separated into main droplets at the head, and subsequent satellite droplets (having a smaller size than the main droplets). FIG. 6 shows main dots formed by the main droplets, and satellite dots formed by the satellite droplets.

The effects of the airflow that occurs between the head surface 13S and the recording surface 5S of the roll paper 5 are greatest when the airflow occurs after the recording head 13 (carriage 41) reverses the travel direction during the main scanning movement (back and forth movement). To assess the effects of this airflow, the recording image shown in FIG. 6 is an image created by moving the recording head 13 (the carriage 41) for main scanning once in the −X direction so that the recording head 13 passes through the recording region, and subsequently reversing the travel direction to the +X direction to discharge one shot of ink droplets simultaneously from all nozzles 43 immediately after the recording head 13 has entered the recording region.

As understood from FIG. 6 as well, the satellite droplets have a small ink droplet size and are thus sensitive to airflow. These satellite droplets are therefore sensitive to the airflow in the −X direction caused by the recording head 13 (the carriage 41) that moved in the −X direction before discharge, and land in the −X direction from the landing position of the main droplets. This shift in landing position can cause a reduction in recording quality, such as deformation of one line into two lines or a thickened line, when an attempt is made to draw a narrow line extending in the Y-axis direction, for example. Further, the size of this shift in landing position, as described later, decreases as the airflow that weakens between the head surface 13S and the recording surface 5S of the roll paper 5 starts. Thus, a difference in the degree of shift occurs in the scanning direction. That is, the degree of shift in landing position lessens as the airflow in the −X direction weakens as the carriage 41 advances in the +X direction. Further, the size of the shift in landing position increases in proportion to the size of the medium gap MG.

Note that, while the stop time is stated as 6 ms in FIG. 6, this stop time is the minimum stop time of the carriage 41 that occurs in association with the reverse operation of the carriage 41, and is not an intended stop time of the carriage 41.

Suppression of Variance in Landing Position of Ink Droplets

Here, according to the recording device of the exemplary embodiment, to suppress the effects of this airflow (the effects of the airflow that occurs between the head surface 13S and the recording surface 5S of the roll paper 5 in association with the reversal of the carriage 41), the electronic controller 30 stops the main scanning unit 40 for a predetermined stop time determined based on the medium gap MG before the pass operation (operation of discharging the ink from the nozzles 43 onto the roll paper 5 during the main scanning operation) is performed. Specifically, because the sensitivity to the airflow increases in proportion to the size of the medium gap MG, the electronic controller 30 lengthens the predetermined stop time in proportion to size of the medium gap MG.

Further, as the recording method of the exemplary embodiment, the main scanning unit 40 is stopped for a predetermined stop time determined based on the medium gap MG before the pass operation is performed.

Note that the predetermined stop time for which the electronic controller 30 stops the main scanning unit 40 (that is, the time for which the drive controller 34 stops the carriage 41 performing a main scanning movement (back and forth movement) at the position where the carriage 41 is reversed) is preferably determined upon adequate assessment in advance. The determined predetermined stop time is stored in a non-volatile storage medium (an EEPROM or the like) constituting the memory 33, and the electronic controller 30 refers to the memory 33 at the time of recording, and performs control, stopping the main scanning unit 40 for the read predetermined stop time.

The assessment performed in advance for determining the predetermined stop time is, for example, an assessment that associates appropriate stop times of the main scanning unit 40 (times for stopping at the position where the carriage 41 is reversed to weaken the occurred airflow) with various sizes of the medium gap MG set in accordance with the type of the roll paper 5 (the thickness and the degree to which floating from the platen 15 occurs). Thus, a data table that associates the medium gaps MG and the predetermined stop times is stored in the memory 33. Further, at the time of recording, the electronic controller 30 refers to the memory 33 to read this data table, recognizes the predetermined stop time corresponding to the medium gap MG set for the roll paper 5 as a recording target, and stops the main scanning unit 40 for that time period.

Figure 7:
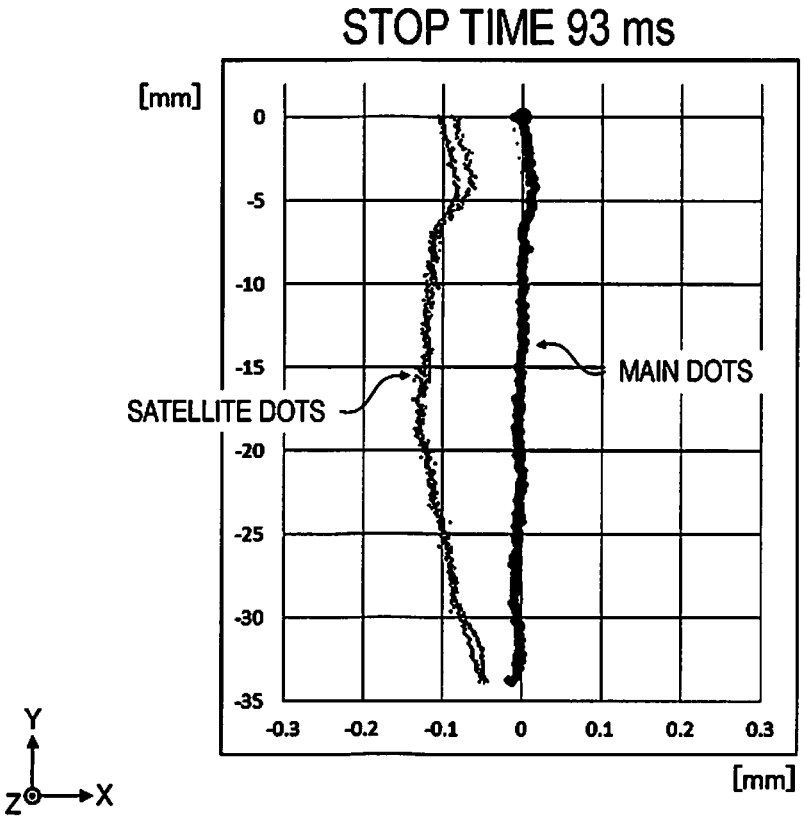
FIG. 7 is an example of a recording image showing the landing positions of ink droplets at a stop time of 93 ms.
Figure 8:
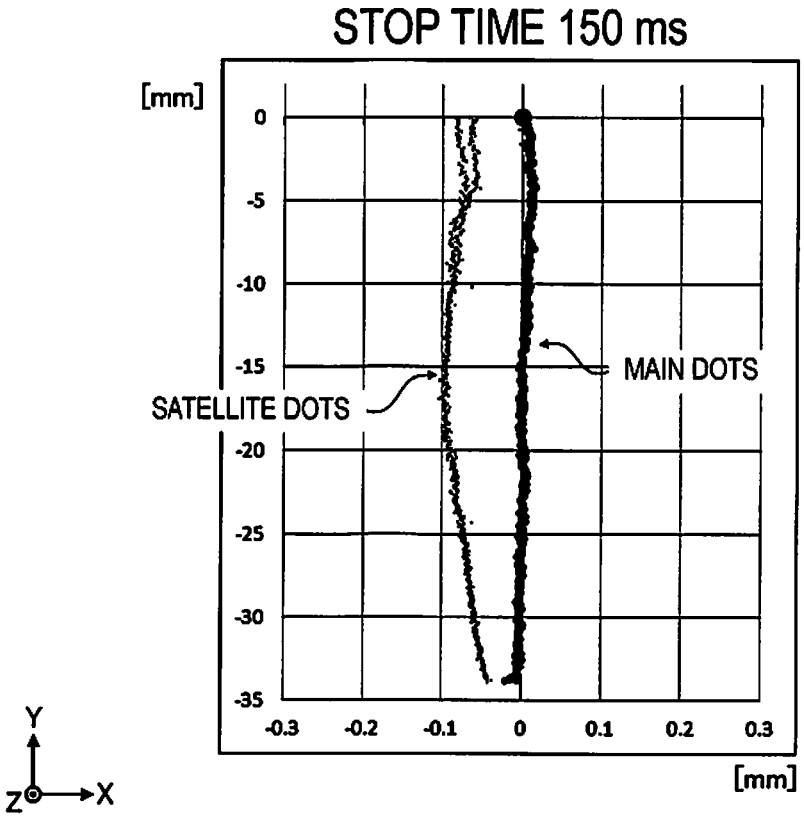
FIG. 8 is an example of a recording image showing the landing positions of ink droplets at a stop time of 150 ms.
Figure 9:
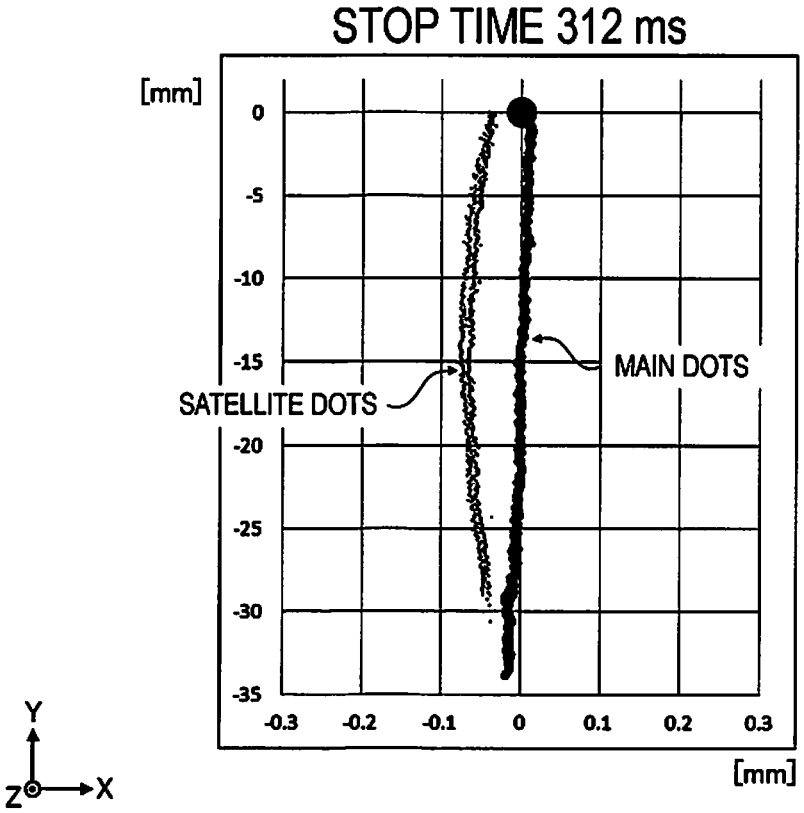
FIG. 9 is an example of a recording image showing the landing positions of ink droplets at a stop time of 312 ms.

FIGS. 7 to 9 are examples of recording images obtain upon assessment of the relationship between the stop time of the main scanning unit 40 and the degree of variance in the landing positions of the ink droplets.

FIGS. 7 to 9 show the landing positions of the ink droplets with the stop times of 93 ms, 150 ms, and 312 ms, respectively. Other than the time for which the main scanning unit 40 is stopped, recording is performed under the same conditions as those for the recording image shown in FIG. 6. As understood upon comparison of FIGS. 6 to 9, in the range in which the assessment was made, the degree of variance in the landing positions of the ink droplets (the difference in landing positions between the main dots and the satellite dots, in particular) decreases as the time for which the main scanning unit 40 is stopped lengthens. That is, the figures show that the degree of variance in the landing positions of the ink droplets decreases as the time for which the main scanning unit 40 is stopped is lengthened and a greater amount of time is taken to weaken the airflow.

Further, because the amount of time that the ink droplets in flight are exposed to the airflow lengthens as the medium gap MG increases in size, and the satellite droplets having a smaller droplet size tend to be more sensitive to airflow, preferably the time taken to weaken the airflow (the predetermined stop time) is lengthened in proportion to the size of the medium gap MG, as in the exemplary embodiment, to further reduce the degree of shift in the landing positions of the main dots and the satellite dots.

Note that the appropriate predetermined stop time is preferably not only determined by the size of the medium gap MG but also by various other parameters.

For example, the electronic controller 30 preferably lengthens the predetermined stop time in proportion to the speed of the main scanning operation. That is, because the airflow strengthens as the travel speed of the carriage 41 increases, preferably the time taken to weaken the airflow (predetermined stop time) is lengthened in proportion to the travel speed of the carriage 41.

Further, for example, the electronic controller 30 preferably lengthens the predetermined stop time in proportion to the length (width) of the roll paper 5 supported by the platen 15 in the main scanning direction.

As the length (the width) of the roll paper 5 lengthens in the main scanning direction, the distance between the roll paper 5 and the position where the carriage 41 is reversed and stopped shortens, and thus the amount of time until the carriage 41 resumes the main scanning movement and discharges the ink droplets after having completed the predetermined stop time is shortened. In particular, when the gap between the recording region and the stop position of the carriage 41 is narrow, the effects are increased, requiring discharge of the ink droplet after the produced airflow has adequately been weakened. Therefore, the electronic controller 30 preferably lengthens the predetermined stop time in proportion to the length (width) of the roll paper 5 supported by the platen 15 in the main scanning direction.

Further, for example, the electronic controller 30 preferably lengthens the predetermined stop time in inverse proportion to the distance from the stop position of the main scanning operation (the position where the carriage 41 is reversed and stopped) to the start position of the pass operation.

Figure 10:
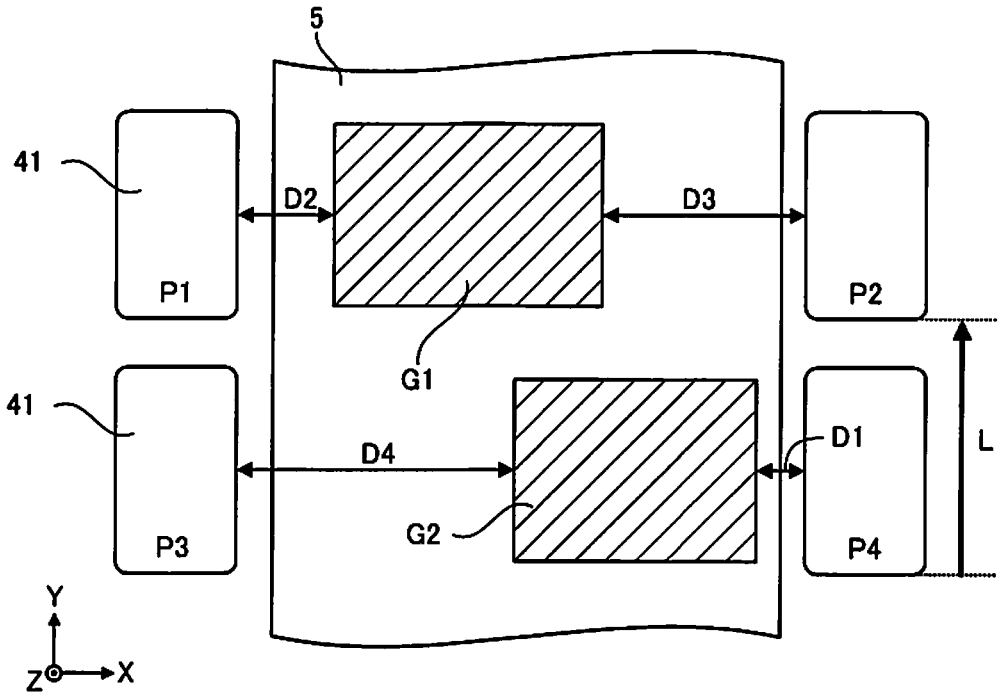
FIG. 10 is a conceptual view illustrating a relationship between a stop position of a main scanning operation and a start position of a pass operation.

FIG. 10 is a conceptual view illustrating the relationship between the stop position of the main scanning operation and the start position of the pass operation.

FIG. 10 illustrates the stop position of the carriage 41 performing the main scanning movement when an image G1 and an image G2 are recorded on the roll paper 5.

When the image G1 is recorded, the carriage 41 performs the main scanning movement between a position P1 and a position P2. The position P1 is a position where the carriage 41 is reversed and stopped on the −X side, and the position P2 is a position where the carriage 41 is reversed and stopped on the +X side.

Further, when the image G2 is recorded, the sub-scanning unit 50 relatively moves the roll paper 5 in the sub-scanning direction by a length L, and the carriage 41 performs the main scanning movement between a position P3 and a position P4. Note that, because the roll paper 5 is moved, the position P1 and the position P3 are the same position, and the position P2 and the position P4 are the same position. However, for illustrative clarity, FIG. 10 illustrates the carriage 41 as moving.

In the example illustrated in FIG. 10, lengths Dn (D1 to D4) from the position where the carriage 41 is reversed and stopped to the position where the pass operation is started (the position where discharge of the ink starts in order to record the image) have the relationship D1<D2<D3<D4. When the distance from the stop position of the carriage 41 to the start position of the pass operation fluctuates in this manner, the electronic controller 30 preferably lengthens the predetermined stop time in inverse proportion to the length Dn. That is, when the predetermined stop time is constant, the amount of time until the ink droplets are discharged after the carriage 41 has resumed the main scanning movement shortens as the length Dn shortens. Thus, the electronic controller 30 preferably lengthens the predetermined stop time in inverse proportion to the length Dn from the stop position of the carriage 41 to the start position of the pass operation (the position where discharge of the ink is started in order to record the image).

Thus, at the longest width of the roll paper 5 supported by the platen 15, there is no need to lengthen the predetermined stop time when the position of the image recorded on the roll paper 5 is separated from the stop position of the carriage 41. Conversely, at the shortest width of the roll paper 5 supported on the platen 15, the predetermined stop time on one side in the main scanning direction is preferably lengthened when the roll paper 5 is supplied to a position close to the stop position of the carriage 41 on one side in the main scanning direction.

Further, as a matter of course, there is no need to provide the predetermined stop time when ink is not discharged in a subsequent main scanning operation.

Figure 11:
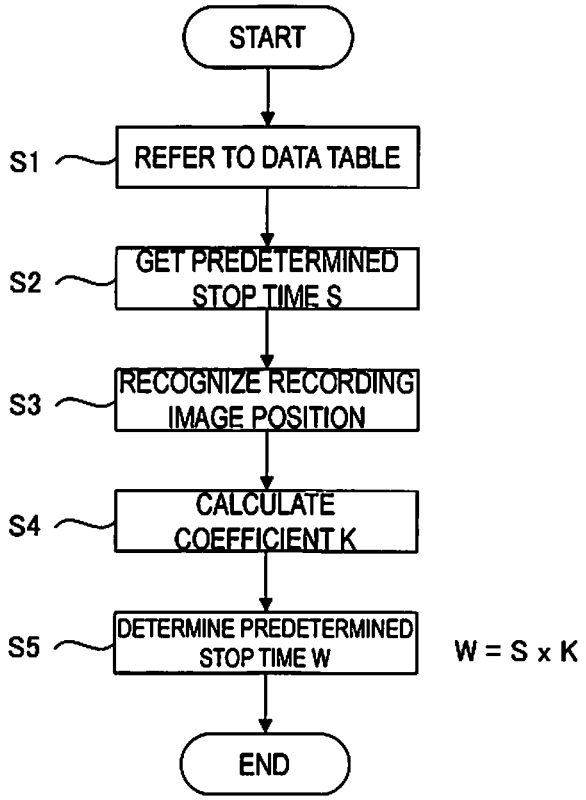
FIG. 11 is a flowchart illustrating an example of processing of an electronic controller when a predetermined stop time is determined.

FIG. 11 is a flowchart illustrating an example of the processing of the electronic controller 30 when the predetermined stop time is thus determined in accordance with the length Dn.

First, at the time of recording, the electronic controller 30 refers to the data table (the data table that associates the medium gap MG and the predetermined stop time) stored in the memory 33 (step S1), and acquires a predetermined stop time S corresponding to the medium gap MG set for the roll paper 5 of the recording target (step S2).

Next, the electronic controller 30 refers to the recording data and recognizes the recording position of the image to be recorded on the roll paper 5 (step S3).

Next, the electronic controller 30 calculates a coefficient K corresponding to the recording position of the recognized image (step S4). Here, the coefficient K is a numerical value corresponding to the length Dn from the stop position of the carriage 41 to the start position of discharge of the ink for recording the image, and is determined in advance as a function of the length Dn.

Next, the electronic controller 30 multiplies the coefficient K by the predetermined stop time S acquired in step S2 to determine an actual predetermined stop time W when the image is to be recorded (step S5).

Note that, when there are a plurality of lengths Dn corresponding to the image to be recorded, the predetermined stop time W found here is found as a plurality of predetermined stop times W for the positions respectively corresponding to the lengths Dn.

Note that the control performed to fluctuate the predetermined stop time in accordance with the length Dn in the subsequent pass operation can be performed by including a command for controlling the predetermined stop time in the commands included in the recording data generated in advance. In the stage of generating the recording data, the length Dn is known, making it possible to provide a function for generating a corresponding command to the printer driver described above.

Further, because the sensitivity to the airflow increases in inverse proportion to the size of the ink discharged, the electronic controller 30 preferably lengthens the predetermined stop time in inverse proportion to the size of the ink discharged.

The electronic controller 30 can recognize the size of the ink discharged in the subsequent pass operation by referring to the recording data for recording. Thus, when discharge of ink of a size below a predetermined ink size (threshold size) set in advance is included in the subsequent pass operation, for example, the electronic controller 30 preferably performs control that lengthens the predetermined stop time. Conversely, when it is recognized in advance that small-sized ink below the threshold size will not be discharged during the period that matches the predetermined stop time until the airflow weakens, there is no need to further lengthen the predetermined stop time (the predetermined stop time can be shortened).

Note that the control performed to fluctuate the predetermined stop time in accordance with the size of the ink to be discharged in the subsequent pass operation can be performed by including a command for controlling the predetermined stop time in the commands included in the recording data generated in advance. In the stage where the recording data is generated, the ink size involved in the pass operation is known, making it possible to provide a function for generating a corresponding command to the printer driver described above.

Further, because the sensitivity to the airflow increases in inverse proportion to the speed of the ink discharged, the electronic controller 30 preferably lengthens the predetermined stop time in inverse proportion to the speed of the ink discharged.

Further, a more appropriate predetermined stop time can be set in response to a user's instruction entered via a user interface configured using the input unit 112 and the display unit 113.

When a user wants to check only the layout of a recording image to be recorded or the like and a recording of high quality is not required, for example, the recording is preferably performed at a higher speed. In such a case, the user can select a recording mode (print mode), for example. Then, when "Quick" is selected from among "High definition", "Very good", and "Quick", for example, control for setting the predetermined stop time to 0 or the like is performed.

Further, when the "High definition" recording mode is selected and a longer time for recording is allowed, for example, control for setting the predetermined stop time to the effective maximum value or the like is performed.

As described above, according to the recording device and the recording method of the exemplary embodiment, the effects below can be achieved.

The electronic controller 30 stops the main scanning unit 40 (that is, stops the main scanning operation of moving the recording head 13 (carriage 41) in the main scanning direction) for a predetermined stop time determined based on the medium gap MG prior to the pass operation (that is, prior to the discharge of ink from the nozzles 43 onto the roll paper 5). Thus, the subsequent pass operation (operation of discharging the ink) can be executed after a momentum of the airflow that occurs in association with the movement of the recording head 13 (the airflow that occurs between the head surface 13S of the recording head 13 and the recording surface 5S of the roll paper 5) has weakened. As a result, the degree to which the landing position of the discharged ink varies due to the effects of the airflow that occurs between the head surface 13S of the recording head 13 and the recording surface 5S of the roll paper 5 is reduced, making it possible to control the deterioration in recording quality.

Further, with the degree of variance in the landing position of the ink caused by the effects of the airflow tending to increase in proportion of the size of the medium gap MG, the subsequent pass operation (operation of discharging the ink) can be executed after further weakening the momentum of the impacting airflow when the time for which the movement of the recording head 13 is stopped (predetermined stop time) is lengthened in proportion to the size of the medium gap MG. As a result, the degree to which the landing position of the discharged ink varies due to the effects of the airflow is reduced, making it possible to control the deterioration in recording quality.

Further, as the speed of the main scanning operation increases, the momentum of the airflow that occurs in association thereto tends to strengthen, increasing the degree of variance in the landing position of the ink caused by such effects. Thus, the subsequent pass operation (operation of discharging the ink) can be executed after weakening the strengthened momentum of the airflow when the time for which the movement of the recording head 13 is stopped (predetermined stop time) is lengthened in proportion to the speed of the main scanning operation. As a result, the degree to which the landing position of the discharged ink varies due to the effects of the airflow is reduced, making it possible to control the deterioration in recording quality.

Further, when recording is performed by repeating the pass operation of discharging the ink from the nozzles 43 onto the roll paper 5 during the main scanning operation of moving the recording head 13 in the main scanning direction followed by the sub-scanning operation, the amount of time until the ink is discharged after the movement of the recording head 13 is reversed in the main scanning operation involving a back and forth movement (main scanning movement) is shortened in inverse proportion to the length (that is, width) of the roll paper 5 supported by the support unit 15 in the main scanning direction. When the amount of time until the ink is discharged after reversal of the movement of the recording head 13 is shortened, sensitivity to the airflow associated with the reversal of the recording head 13 (the airflow that occurs between the head surface 13S of the recording head 13 and the recording surface 5S of the roll paper 5) increases. Thus, when the predetermined stop time is lengthened in proportion to the length of the roll paper 5 supported on the platen 15 in the main scanning direction, the subsequent pass operation (operation of discharging the ink) can be executed after further weakening the effects of the airflow. As a result, the degree to which the landing position of the discharged ink varies due to the effects of the airflow is reduced, making it possible to control the deterioration in recording quality.

Further, the sensitivity to the airflow associated with reversal of the recording head 13 (the airflow that occurs between the head surface 13S of the recording head 13 and the recording surface 5S of the roll paper 5) increases in inverse proportion to the distance from the stop position of the recording head 13 to the start position of ink discharge. Thus, the subsequent pass operation (operation of discharging the ink) can be executed after further weakening the airflow by lengthening the predetermined stop time in inverse proportion to the distance from the stop position of the main scanning operation to the start position of the pass operation in which ink is discharged from the nozzles 43 onto the roll paper 5 during the main scanning operation. As a result, the degree to which the landing position of the discharged ink varies due to the effects of the airflow is reduced, making it possible to control the deterioration in recording quality.

Further, the sensitivity to the airflow (the airflow that occurs between the head surface 13S of the recording head 13 and the recording surface 5S of the roll paper 5) increases in inverse proportion to the size of the ink discharged from the recording head 13 onto the roll paper 5. Thus, the subsequent pass operation (operation of discharging the ink) can be executed after further weakening the momentum of the impacting airflow by lengthening the predetermined stop time in inverse proportion to the size of the ink discharged. As a result, the degree to which the landing position of the discharged ink varies due to the effects of the airflow is reduced, making it possible to control the deterioration in recording quality.

Further, the sensitivity to the airflow (the airflow that occurs between the head surface 13S of the recording head 13 and the recording surface 5S of the roll paper 5) increases in inverse proportion to the speed of the ink discharged from the recording head 13 onto the roll paper 5. Thus, the subsequent pass operation (operation of discharging the ink) can be executed after further weakening the momentum of the impacting airflow by lengthening the predetermined stop time in inverse proportion to the speed of the ink discharged. As a result, the degree to which the landing position of the discharged ink varies due to the effects of the airflow is reduced, making it possible to control the deterioration in recording quality.

Further, according to the recording method of the exemplary embodiment, the main scanning unit 40 is stopped (that is, the main scanning operation of moving the recording head 13 in the main scanning direction is stopped) for a predetermined stop time determined based on the medium gap MG prior to the pass operation (that is, prior to the discharge of ink from the nozzles 43 onto the roll paper 5). Thus, the subsequent pass operation (operation of discharging the ink) can be executed after the momentum of the airflow that occurs in association with the movement of the recording head 13 (the airflow that occurs between the head surface 13S of the recording head 13 and the recording surface 5S of the roll paper 5) has weakened. As a result, the degree to which the landing position of the discharged ink varies due to the effects of the airflow that occurs between the head surface 13S of the recording head 13 and the recording surface 5S of the roll paper 5 is reduced, making it possible to control the deterioration in recording quality.

Figure 12:
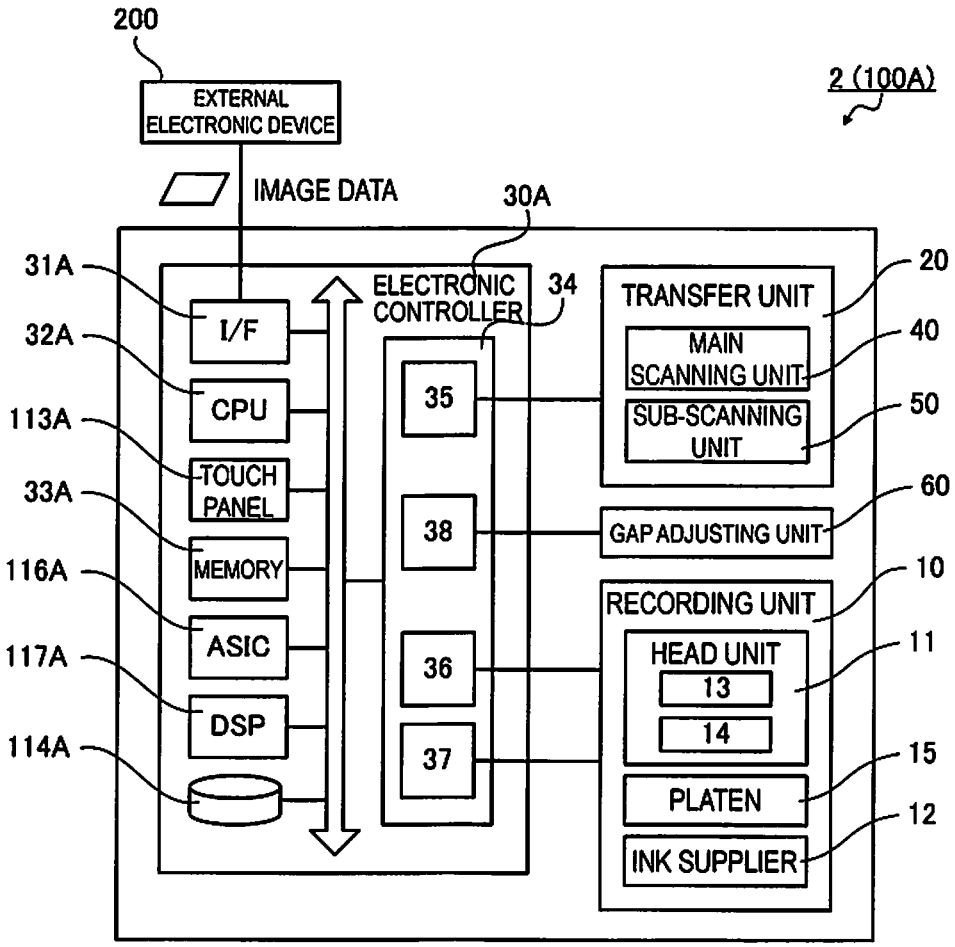
FIG. 12 is a block view illustrating a configuration of a different recording device.

Note that while in the exemplary embodiment described above the recording device 1 is configured by the printer 100 and the image processor 110 that uses a personal computer, the configuration is not limited thereto. For example, the recording device can be configured by providing the functions of the image processor 110 to an electronic controller 30A of a printer 100A, as in a recording device 2 (printer 100A) illustrated in FIG. 12.

Specifically, the electronic controller 30A of the recording device 2 includes an interface 31A, a CPU 32A, a memory 33A, a drive controller 34, a touch panel 113A, a storage unit 114A, an ASIC 116A, and a DSP 117A. Further, the software run on the electronic controller 30A includes an application for handling the recording image data to be recorded, and a printer driver.

The external electronic device 200 is connected to the interface 31A, making it possible to acquire the recording data to be recorded, and the like.

The CPU 32A is an arithmetic processing unit for overall control of the recording device 2.

The memory 33A is a storage medium that secures a region for storing programs run by the CPU 32A, a work region for running such programs, and the like, and includes storage elements such as a RAM and an EEPROM.

The touch panel 113A is an information input means and information display means serving as a human interface.

The storage unit 114A is a rewritable storage medium such as a hard disk drive (HDD) or a memory card, and stores software for controlling the recording device 2 (programs run by the electronic controller 30A), an image to be recorded, information related to a recording job, and the like.

Processing for generating the recording data by the printer driver is performed by the ASIC 116A and the DSP 117A under the control of the CPU 32A.

The electronic controller 30A, similar to the exemplary embodiment described above, stops the main scanning unit 40 (that is, stops the main scanning operation of moving the recording head 13 in the main scanning direction) for a predetermined stop time determined based on the medium gap MG prior to the pass operation (that is, prior to the discharge of ink from the nozzles 43 onto the roll paper 5). Thus, the subsequent pass operation (operation of discharging the ink) can be executed after the momentum of the airflow that occurs in association with the movement of the recording head 13 (the airflow that occurs between the head surface 13S of the recording head 13 and the recording surface 5S of the roll paper 5) has weakened. As a result, the degree to which the landing position of the discharged ink varies due to the effects of the airflow that occurs between the head surface 13S of the recording head 13 and the recording surface 5S of the roll paper 5 is reduced, making it possible to control the deterioration in recording quality.

A recording device according to an example is a recording device including a recording head provided with a head surface including an array of nozzles that discharge ink onto a recording medium, a support unit configured to support the recording medium, a main scanning unit configured to perform a main scanning operation of moving the recording head in a main scanning direction, a sub-scanning unit configured to perform a sub-scanning operation of moving the recording medium relative to the recording head in a sub-scanning direction intersecting with the main scanning direction, a gap adjusting unit configured to adjust a gap that is a distance between the head surface and a recording surface of the recording medium supported by the support unit, and an electronic controller configured to control driving of the main scanning unit, the sub-scanning unit, and the gap adjusting unit. The recording device is configured to perform recording on the recording medium by repeating a pass operation of discharging the ink from the nozzles onto the recording medium during the main scanning operation, and the sub-scanning operation, and the electronic controller is configured to stop the main scanning unit for a predetermined stop time determined based on the gap prior to the pass operation.

According to the example described above, the electronic controller is configured to stop the main scanning unit (that is, stop the main scanning operation of moving the recording head in the main scanning direction) for a predetermined stop time determined based on the gap prior to the pass operation (that is, prior to the discharge of the ink from the nozzles onto the recording medium). Thus, the subsequent pass operation (operation of discharging the ink) can be executed after a momentum of an airflow that occurs in association with the movement of the recording head (an airflow that occurs between the head surface of the recording head and the recording surface of the recording medium) has weakened. As a result, the degree to which the landing position of the discharged ink varies due to the effects of the airflow that occurs between the head surface of the recording head and the recording surface of the recording medium is reduced, making it possible to control a deterioration in recording quality.

In the recording device according to the example described above, the electronic controller is configured to lengthen the predetermined stop time in proportion to a size of the gap.

According to the example described above, the predetermined stop time for which the main scanning operation of moving the recording head in the main scanning direction is stopped lengthens in proportion to the size of the gap (the distance between the head surface and the recording surface of the recording medium supported by the support unit). With the degree of variance in the landing position of the ink caused by the effects of the airflow tending to increase in proportion of the size of the gap, the subsequent pass operation (operation of discharging the ink) can be executed after further weakening the momentum of the impacting airflow by lengthening the time for which the movement of the recording head is stopped (predetermined stop time) in proportion to the size of the gap. As a result, the degree to which the landing position of the discharged ink varies due to the effects of the airflow is reduced, making it possible to control the deterioration in recording quality.

In the recording device according to the example described above, the electronic controller is configured to lengthen the predetermined stop time in proportion to a speed of the main scanning operation.

According to the example described above, the time for which the movement of the recording head is stopped (predetermined stop time) lengthens in proportion to the speed of the main scanning operation of moving the recording head in the main scanning direction. As the speed of the main scanning operation increases, the momentum of the airflow that occurs in association thereto tends to strengthen, increasing the degree of variance in the landing position of the ink due to such effects. Thus, the subsequent pass operation (operation of discharging the ink) can be executed after weakening the strengthened momentum of the airflow by lengthening the time for which the movement of the recording head is stopped (predetermined stop time) in proportion to the speed of the main scanning operation. As a result, the degree to which the landing position of the discharged ink varies due to the effects of the airflow is reduced, making it possible to control the deterioration in recording quality.

In the recording device according to the example described above, the electronic controller is configured to lengthen the predetermined stop time in proportion to a length of the recording medium supported by the support unit in the main scanning direction.

When recording is performed by repeating the pass operation of discharging the ink from the nozzles onto the recording medium during the main scanning operation of moving the recording head in the main scanning direction followed by the sub-scanning operation, the amount of time until the ink is discharged after the movement of the recording head is reversed in the main scanning operation involving a back and forth movement (main scanning movement) is shortened in inverse proportion to the length (that is, width) of the recording medium supported by the support unit in the main scanning direction. When the amount of time until the ink is discharged after reversal of the movement of the recording head is shortened, sensitivity to the airflow associated with the reversal of the recording head (the airflow that occurs between the head surface of the recording head and the recording surface of the recording medium) increases.

According to the example described above, the predetermined stop time lengthens in proportion to the length of the recording medium supported by the support unit in the main scanning direction, making it possible to execute the subsequent pass operation (operation of discharging the ink) after further weakening the effects of the airflow. As a result, the degree to which the landing position of the discharged ink varies due to the effects of the airflow is reduced, making it possible to control the deterioration in recording quality.

In the recording device according to the example described above, the electronic controller is configured to lengthen the predetermined stop time in inverse proportion to a distance from a stop position of the main scanning operation to a start position of the pass operation.

The sensitivity to the airflow (the airflow that occurs between the head surface of the recording head and the recording surface of the recording medium) associated with reversal of the recording head increases in inverse proportion to the distance from the stop position of the main scanning operation (that is, the position where movement of the recording head is reversed in the main scanning operation involving a back and forth movement (main scanning movement)) to the start position of ink discharge.

According to the example described above, the predetermined stop time lengthens in inverse proportion to the distance from the stop position of the main scanning operation of moving the recording head in the main scanning direction to the start position of pass operation of discharging the ink from the nozzles onto the recording medium in the main scanning operation. Thus, the subsequent pass operation (operation of discharging the ink) can be executed after further weakening the effects of the airflow. As a result, the degree to which the landing position of the discharged ink varies due to the effects of the airflow is reduced, making it possible to control the deterioration in recording quality.

In the recording device according to the example described above, the electronic controller is configured to lengthen the predetermined stop time in inverse proportion to a size of the ink discharged.

The sensitivity to the airflow (the airflow that occurs between the head surface of the recording head and the recording surface of the recording medium) increases in inverse proportion to the size of the ink discharged from the recording head onto the recording medium.

According to the example described above, the predetermined stop time lengthens in inverse proportion to the size of the discharged ink, making it possible to execute the subsequent pass operation (operation of discharging the ink) after further weakening the momentum of the impacting airflow in proportion to the sensitivity to the airflow. As a result, the degree to which the landing position of the discharged ink varies due to the effects of the airflow is reduced, making it possible to control the deterioration in recording quality.

In the recording device according to the example described above, the electronic controller is configured to lengthen the predetermined stop time in inverse proportion to a speed of the ink discharged.

The sensitivity to the airflow (the airflow that occurs between the head surface of the recording head and the recording surface of the recording medium) increases in inverse proportion to the speed of the ink discharged from the recording head onto the recording medium.

According to the example described above, the predetermined stop time lengthens in inverse proportion to the speed of the discharged ink, making it possible to execute the subsequent pass operation (operation of discharging the ink) after further weakening the momentum of the impacting airflow in proportion to the sensitivity to the airflow. As a result, the degree to which the landing position of the discharged ink varies due to the effects of the airflow is reduced, making it possible to control the deterioration in recording quality.

A recording method according to the example is a recording method for performing recording using a recording device including a recording head provided with a head surface including an array of nozzles that discharge ink onto a recording medium, a support unit configured to support the recording medium, a main scanning unit configured to perform a main scanning operation of moving the recording head in a main scanning direction, a sub-scanning unit configured to perform a sub-scanning operation of moving the recording medium relative to the recording head in a sub-scanning direction intersecting with the main scanning direction, a gap adjusting unit configured to adjust a gap that is a distance between the head surface and a recording surface of the recording medium supported by the support unit, and an electronic controller configured to control driving of the main scanning unit, the sub-scanning unit, and the gap adjusting unit. The recording device is configured to perform recording on the recording medium by repeating a pass operation of discharging the ink from the nozzles onto the recording medium during the main scanning operation, and the sub-scanning operation. The recording method includes stopping the main scanning unit for a predetermined stop time determined based on the gap prior to the pass operation.

According to the example described above, the main scanning unit is stopped (that is, the main scanning operation of moving the recording head in the main scanning direction is stopped) for a predetermined stop time determined based on the gap prior to the pass operation (that is, prior to discharging the ink from the nozzles onto the recording medium). Thus, the subsequent pass operation (operation of discharging the ink) can be executed after a momentum of the airflow that occurs in association with the movement of the recording head (the airflow that occurs between the head surface of the recording head and the recording surface of the recording medium) has weakened. As a result, the degree to which the landing position of the discharged ink varies due to the effects of the airflow that occurs between the head surface of the recording head and the recording surface of the recording medium is reduced, making it possible to control a deterioration in recording quality.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a recording head including a head surface that has an array of nozzles configured to discharge ink onto a recording medium;

a support unit configured to support the recording medium;

a main scanning unit configured to perform a main scanning operation of moving the recording head in a main scanning direction;

a sub-scanning unit configured to perform a sub-scanning operation of moving the recording medium relative to the recording head in a sub-scanning direction intersecting with the main scanning direction;

a gap adjusting unit configured to adjust a gap that is a distance between the head surface and a recording surface of the recording medium supported by the support unit; and an electronic controller configured to control driving of the main scanning unit, the sub-scanning unit, and the gap adjusting unit, the recording device being configured to perform recording on the recording medium by repeating the sub-scanning and pass operations that include at least a first pass operation in which the recording head moves from a first position to a second position in a first direction along the main scanning direction and the nozzles discharge the ink onto the recording medium, and a second pass operation in which the recording head moves from the second position to the first position in a second direction along the main scanning direction and the nozzles discharge the ink from the nozzles onto the recording medium, the first direction being opposite to the second direction, and the electronic controller being configured to stop the main scanning unit for a predetermined stop time determined based on the gap, after the first pass operation and prior to the second pass operation, wherein when the gap is a first distance, the electronic controller is configured to stop the main scanning unit for a first time after the first pass operation and prior to the second pass operation, and the first time is longer than a second time for which the electronic controller is configured to stop the main scanning unit after the first pass operation and prior to the second pass operation when the gap is a second distance less than the first distance.

2. The recording device according to claim 1, wherein the electronic controller is configured to lengthen the predetermined stop time in proportion to a size of the gap.

3. The recording device according to claim 1, wherein the electronic controller is configured to lengthen the predetermined stop time in proportion to a speed of the main scanning operation.

4. The recording device according to claim 1, wherein the electronic controller is configured to lengthen the predetermined stop time in proportion to a length in the main scanning direction that the recording medium supported by the support unit has.

5. The recording device according to claim 1, wherein the electronic controller is configured to lengthen the predetermined stop time in inverse proportion to a distance from a stop position of the main scanning operation to a start position of the second pass operation.

6. The recording device according to claim 1, wherein the electronic controller is configured to lengthen the predetermined stop time in inverse proportion to a size of the ink discharged.

7. The recording device according to claim 1, wherein the electronic controller is configured to lengthen the predetermined stop time in inverse proportion to a speed of the ink discharged.

8. The recording device according to claim 1, wherein the electronic controller is configured to set the predetermined stop time to the first time when the gap is the first distance and a speed of the main scanning operation is a first speed, and the first time is longer than a third time to which the electronic controller is configured to set the predetermined stop time when the gap is the second distance and the speed of the main scanning operation is a second speed less than the first speed.

9. The recording device according to claim 1, wherein the electronic controller is configured to set the predetermined stop time to the first time when the gap is the first distance and a length in the main scanning direction of the recording medium supported by the support unit is a first length, and the first time is longer than a fourth time to which the electronic controller is configured to set the predetermined stop time when the gap is the second distance and the length in the main scanning direction of the recording medium supported by the support unit is a second length less than the first length.

10. The recording device according to claim 1, wherein the electronic controller is configured to set the predetermined stop time to the first time when the gap is the first distance and a distance from a stop position of the main scanning operation to a start position of the second pass operation of the main scanning operation is a first distance, and the first time is longer than a fifth time to which the electronic controller is configured to set the predetermined stop time when the gap is the second distance and the distance from the stop position of the main scanning operation to the start position of the second pass operation of the main scanning operation is a second distance greater than the first distance.

11. The recording device according to claim 1, wherein the electronic controller is configured to set the predetermined stop time to the first time when the gap is the first distance and a size of the ink discharged is a first size, and the first time is longer than a sixth time to which the electronic controller is configured to set the predetermined stop time when the gap is the second distance and the size of the ink discharged is a second size greater than the first size.

12. The recording device according to claim 1, wherein the electronic controller is configured to set the predetermined stop time to the first time when the gap is the first distance and a speed of the ink discharged is a first speed, and the first time is longer than a seventh time to which the electronic controller is configured to set the predetermined stop time when the gap is the second distance and the speed of the ink discharged is a second speed greater than the first speed.

13. A recording method for performing recording using a recording device including:

a recording head including a head surface that has an array of nozzles configured to discharge ink onto a recording medium;

a support unit configured to support the recording medium;

a main scanning unit configured to perform a main scanning operation of moving the recording head in a main scanning direction;

a sub-scanning unit configured to perform a sub-scanning operation of moving the recording medium relative to the recording head in a sub-scanning direction intersecting with the main scanning direction;

a gap adjusting unit configured to adjust a gap that is a distance between the head surface and a recording surface of the recording medium supported by the support unit; and an electronic controller configured to control driving of the main scanning unit, the sub-scanning unit, and the gap adjusting unit, the recording method comprising:

performing recording on the recording medium by repeating the sub-scanning operation and pass operations that include at least a first pass operation in which the recording head moves from a first position to a second position in a first direction along the main scanning direction and the nozzles discharge the ink onto the recording medium, and a second pass operation in which the recording head moves from the second position to the first position in a second direction along the main scanning direction and the nozzles discharge the ink from the nozzles onto the recording medium, the first direction being opposite to the second direction; and stopping the main scanning unit for a predetermined stop time determined based on the gap, after the first pass operation and prior to the second pass operation, wherein in the stopping of the main scanning unit, when the gap is a first distance, the main scanning unit is stopped for a first time after the first pass operation and prior to the second pass operation, and the first time is longer than a second time for which the main scanning unit is stopped after the first pass operation and prior to the second pass operation when the gap is a second distance less than the first distance.

14. The recording method according to claim 13, further comprising setting the predetermined stop time to the first time when the gap is the first distance and a speed of the main scanning operation is a first speed, the first time being longer than a third time to which the predetermined stop time is set when the gap is the second distance and the speed of the main scanning operation is a second speed less than the first speed.

15. The recording method according to claim 13, further comprising setting the predetermined stop time to the first time when the gap is the first distance and a length in the main scanning direction of the recording medium supported by the support unit is a first length, the first time being longer than a fourth time to which the predetermined stop time is set when the gap is the second distance and the length in the main scanning direction of the recording medium supported by the support unit is a second length less than the first length.

16. The recording method according to claim 13, further comprising setting the predetermined stop time to the first time when the gap is the first distance and a distance from a stop position of the main scanning operation to a start position of the second pass operation of the main scanning operation is a first distance, the first time being longer than a fifth time to which the predetermined stop time is set when the gap is the second distance and the distance from the stop position of the main scanning operation to the start position of the second pass operation of the main scanning operation is a second distance greater than the first distance.

17. The recording method according to claim 13, further comprising setting the predetermined stop time to the first time when the gap is the first distance and a size of the ink discharged is a first size, the first time being longer than a sixth time to which the predetermined stop time is set when the gap is the second distance and the size of the ink discharged is a second size greater than the first size.

18. The recording method according to claim 13, further comprising setting the predetermined stop time to the first time when the gap is the first distance and a speed of the ink discharged is a first speed, the first time being longer than a seventh time to which the predetermined stop time is set when the gap is the second distance and the speed of the ink discharged is a second speed greater than the first speed.

* * * * *